US006315674B1

(12) United States Patent
Slade et al.

(10) Patent No.: US 6,315,674 B1
(45) Date of Patent: Nov. 13, 2001

(54) AMUSEMENT RIDE FOR VERTICAL MOVEMENT OF PASSENGERS

(75) Inventors: E. Clay Slade, North Logan; Janos I. Lakatos, Salt Lake City; Clayton R. Carter, North Logan; Flint O. Hamblin, Logan; Layne W. Finlinson, Smithfield, all of UT (US)

(73) Assignee: Interactive Rides, Inc., North Logan, UT (US)

( * ) Notice: Subject to any disclaimer, the term of this patent is extended or adjusted under 35 U.S.C. 154(b) by 0 days.

(21) Appl. No.: 09/641,601

(22) Filed: Aug. 18, 2000

(51) Int. Cl.[7] ..... A63G 31/00
(52) U.S. Cl. ..... 472/131; 472/39
(58) Field of Search ..... 472/2, 50, 49, 472/131, 135, 136, 39, 33; 482/77, 69; 104/53

(56) References Cited

U.S. PATENT DOCUMENTS 6,022,276 * 2/2000 Knijpstra ..... 472/33

* cited by examiner

*Primary Examiner*—Kien T. Nguyen
(74) *Attorney, Agent, or Firm*—Thorpe North & WesternLLp

(57) ABSTRACT

An amusement ride for providing vertical movement of a passenger is disclosed. Typically, a support tower having a vertical movement mechanism defining a vertical movement path is present. The carriage is typically coupled to the movement mechanism for providing travel along the vertical movement path. Connected to the carriage is a support structure which extends radially from the carriage for supporting passenger seats. The support structure can be a wall, a rigid post, or some other structure extending outwardly from the tower. In one embodiment, the seats can be positioned along the support structure such that a first seat is closer to the carriage than a second seat. The passenger seats can be positioned to face outwardly or toward other passenger seats. Additionally, the passenger seats can be coupled to the support structure along a support structure side, above the support structure, beneath the support structure, or any combination thereof.

37 Claims, 3 Drawing Sheets

AMUSEMENT RIDE FOR VERTICAL MOVEMENT OF PASSENGERS

FIELD OF THE INVENTION

The present invention is directed to an amusement ride for vertical movement of passengers.

BACKGROUND OF THE INVENTION

Many amusement rides have been developed over the years which are directed to providing passengers with the exhilaration of rapid vertical movement in a safe manner. Typically, a support tower has been used to either suspend a passenger by a cord, or the support tower acts to vertically track a passenger cart or carriage. Several inventions in this field have been previously patented.

One vertically moving amusement ride is described in U.S. Pat. No. 5,704,841. There, a piston having a cable attached to it is slidably mounted in a bore. As the piston is moved, the cable also moves. The cable is configured to proceeds along the bore through a first aperture near the first end of the housing, around a first pulley, along the exterior of the housing, around a second pulley, through a second aperture near the second end of the housing, and along the bore again before entering or attaching to the piston. The second end of the cable is connected to the first end of the cable forming a cable loop. A carrier is attached to the cable along the exterior of the housing such that when the carrier is near the second end of the housing when the piston is near the first end of the housing. Compressed gas can be used to move the piston within the bore. An exhaust valve is designed to be opened or closed. Additionally, a deceleration control valve located near the first end of the housing and closer to the first end of the housing than the exhaust valve is present and can be adjusted to provide a desired effect. By selectively injecting compressed gas into the bore at the two locations and by controlling the exhaust valve and the deceleration control valve, at least five modes of oscillation may be achieved.

In other disclosures, other mechanisms are disclosed. For example, in U.S. Pat. No. 5,417,616, a carrier is moved vertically and its travel controlled by a guide cable. Compressed air flows into the bottom of an acceleration tube to eject the carrier. At the upper end of the guide cable, an emergency deceleration tube provides pneumatic braking. In U.S. Pat. No. 4,487,410, a spherical passenger-holding body is disclosed which has a diameter slightly smaller than that of a tube. A turbine forces air into the bottom of the tube, raising the carrier in the tube. In U.S. Pat. No. 4,545,574, a similar device is disclosed having an additional feature wherein the turbine draws air from the top of the tube rather than pushing air into the bottom of the tube. In U.S. Pat. No. 5,447,221, a cab is raised within a tube by the creation of suction at the top of the tube. Deceleration is produced by decreasing the vacuum above the carrier. A valve can be opened to allow air to enter the tube at a rate which causes the carrier to descend at specific speeds. In U.S. Pat. No. 3,949,953, a transporter is raised inside of a shaft from a lower horizontal level to the top of the shaft with pressurized air supplied below the carrier by compressors. The top of the shaft incorporates restraining means to hold the carrier at that position. A non-return valve precludes air from leaving the bottom of the shaft, thereby limiting the speed of deceleration under emergency conditions. In U.S. Pat. No. 4,997,060, a gondola chute combination is disclosed. The chute has an air vent at its upper end and an air vent at its lower end. An air motor can force air through the lower vent.

When the air motor brings air into the chute below the carrier, the carrier is raised. For a deceleration, the carrier falls under the force of gravity. The rate of deceleration can be increased by removing air from below the carrier with the air motor. The rate of deceleration can be reduced by closing the upper vent to create a vacuum above the carrier, by closing the lower vent, or by using the air motor to bring additional air into the chute below the carrier.

Though many of these amusement rides provide an effective means of vertical travel, it would be useful to provide an amusement ride for vertical movement utilizing these and other known movement mechanisms such that the carrier or cart has support arms or walls which extending outwardly or radially from the tower. Thus, a plurality of passenger seats may be configured radially with respect to one another. Additionally, it would be desirable to provide a carrier wherein more passengers could participate on a single ride, and optionally, face other passengers during the ride experience. These and other advantages may be realized by the practice of the present invention.

SUMMARY OF THE INVENTION

An amusement ride for providing vertical movement of a passenger is disclosed. Typically, a support tower having a vertical movement mechanism defining a vertical movement path is present. In some instances, the tower may act as a track for a carriage. The carriage is typically coupled to a movement mechanism for providing travel along the vertical movement path. Connected to the carriage is a support structure which extends radially from the carriage for supporting passenger seats.

In one embodiment, at least two passenger seats are coupled to a side surface of a support structure wherein the side surface is essentially perpendicular to the tower. In another embodiment, the support structure extends radially from the tower to form a radially extended surface distal to the tower, a first side surface, and an opposing second side surface, such that a first passenger seat coupled to the first side surface and a second passenger seat coupled to the opposing second side surface. In still another embodiment, the passenger carrier for travel along the vertical movement path comprises a carriage movably coupled to the tower along the vertical movement path, a plurality of support structures coupled to and extending radially from the carriage, and at least two seats coupled to each of the outwardly extending or radially extending support structures. In each of these embodiments, the support structure on the carriage can be a wall (or walls) having a first large surface, an opposing second large surface, and an edge coupled to the vertical movement mechanism and at least one passenger seat coupled to one of the first or second large surfaces. In yet another embodiment, the amusement ride comprises a tower defining an essentially vertical movement path, a carriage moveably attached to the tower for travel along the vertical movement path, and a first seat and a second seat positioned on the carriage radially with respect to the tower such that the first seat is essentially between the tower and the second seat. Though the seats can be positioned to face in any direction, in one embodiment, the passenger seats can be configured to face other passenger seats, either on the same support structure or on adjacent support structures. For example, the carriage can comprise a first support structure coupled to the carriage, a second support structure coupled to the carriage, a first chair attached to the first support structure, and a second chair attached to the second support structure such that the second chair is positioned to substantially face the first chair, and/or vice versa.

BRIEF DESCRIPTION OF THE DRAWINGS

In the accompanying drawings which illustrate embodiments of the invention.

DETAILED DESCRIPTION OF THE INVENTION

Before the present invention is disclosed and described, it is to be understood that this invention is not limited to the particular configurations, process steps and materials disclosed herein as these may vary to some degree. It is also to be understood that the terminology used herein is used for the purpose of describing particular embodiments only, and is not intended to be limiting as the scope of the present invention. The invention will be limited only by the appended claims and equivalents thereof.

The terms "radiate" or "radially" when used in the context of support structures or passenger seats are meant to include support structures or passenger seats which extend outwardly from the carriage and/or tower. However, in the context of the present invention, these terms are not meant to include only right angle outwardly extending structures. Support structures and passenger seats which are radially configured with respect to the tower can radiate at other functional angles other than right angles.

Figure 1:
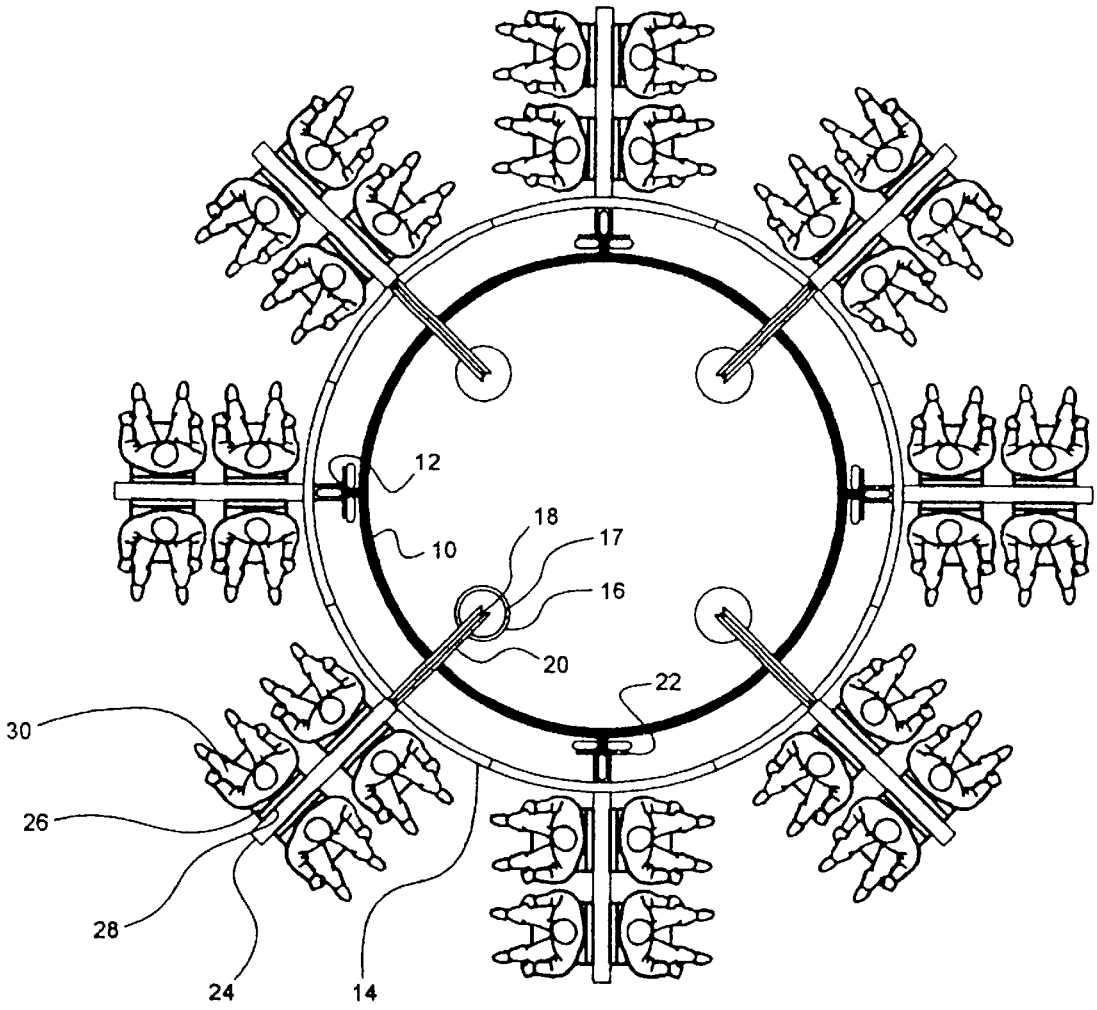
FIG. 1 is a schematic overhead view of the amusement ride showing one embodiment of the present invention.

Referring to FIG. 1, a schematic overhead view of an embodiment of the amusement ride of the present invention is shown. A tower structure 10 is shown having four vertical tracks 12 coupled to the tower 10, or alternatively, the vertical tracks 12 are part of the tower 10 itself. A cart or carriage 14 is positioned concentrically and externally with respect to the tower 10. The carriage 14 is configured to move along a vertical movement path (not shown) and is powered by a cable 18 movably coupled to rollers 20. In one embodiment, the cable 18 and rollers 20 are powered by sheaves connected to a piston 17 which is contained within a cylinder 16. Thus, by injecting a gas through a cylinder 16, a piston 17 within the cylinder 16 which is connected to a cable 18 on rollers 20 act to vertically thrust the carriage 14 (either upwardly or downwardly). The carriage 14, is stabilized horizontally with respect to the tower 10 by a group of carriage rollers or slides 22 immovably coupled to the carriage 14 and slidably or rollably coupled to the tracks 12.

A support structure 24 is coupled to the carriage 14 such that the support structure 24 radially extends from the carriage 14 and the tower 10. Though the support structure 24 is essentially perpendicular to the carriage 14, this is not required. The support structure 24 can be configured to extend or radiate from the carriage 14 at angles less than or greater than 90 degrees. A plurality of passenger seats 26 are coupled to the support structure 24 such that the back 28 of passenger seats 26 are attached firmly to the support structure 24. When arranged in this manner, multiple passenger seats 26 can be coupled to a single support structure 24 as is shown. Additionally, if multiple support structures are configured around a cylindrical or circular carriage 14 as shown, passengers 30 can be positioned so that they can easily see other passengers as well as see the surrounding area. Though a circular or cylindrical carriage 14 is shown, other shapes can be used including rectangular, oval, irregular, triangular, pentagonal, hexagonal, etc. Each carriage shape having strategically placed support structures 24 could provide different effects to the passenger 30, e.g., from viewing another passenger to viewing away from other passengers.

Figure 2:
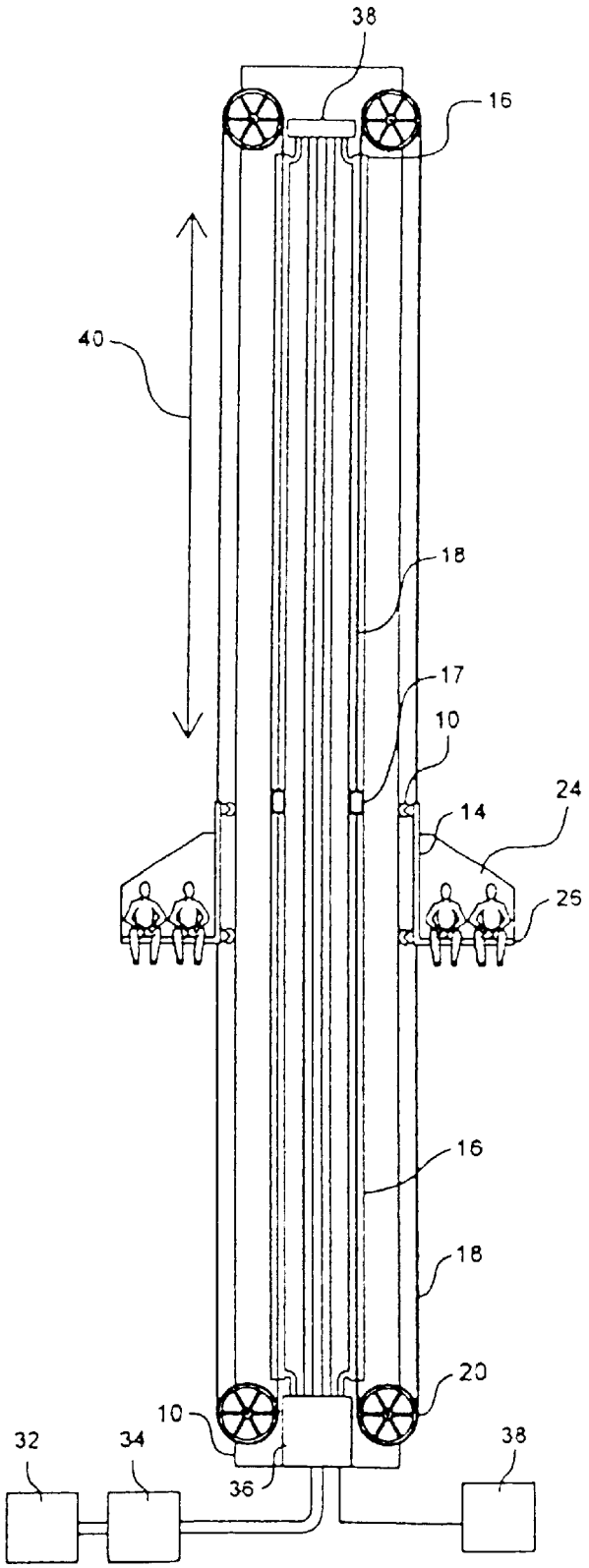
FIG. 2 is a schematic front view of the amusement ride showing one embodiment of the present invention.

Turning now to FIG. 2, a front view of an embodiment of the amusement ride is shown. A carriage 14 having a support structure or support wall 24 and radiating seats 26 are present in about mid-position on the track 10 (which is the tower in this embodiment). Carriage rollers or sliders 22 provide the slidable or rollable connection between the carriage 14 and the track or tower 10. The carriage 14 is moved vertically by a cable system comprising an air compressor 34 fluidly connected to an accumulator 34, which in combination, act to control the upward or downward thrust and/or falling or raising of a piston 17 within a cylinder 16. As the piston 17 is thrust vertically, a cable which is attached to the piston moves around the cable rollers 20 causing the carriage 14 to move vertically along a vertical movement path 40. An electromechanical control system 36 acts to regulate the operating systems so that the carriage 14 moves in an appropriate manner. Additionally, a valving system 38 is present for release and/or intake of air.

Figure 3:
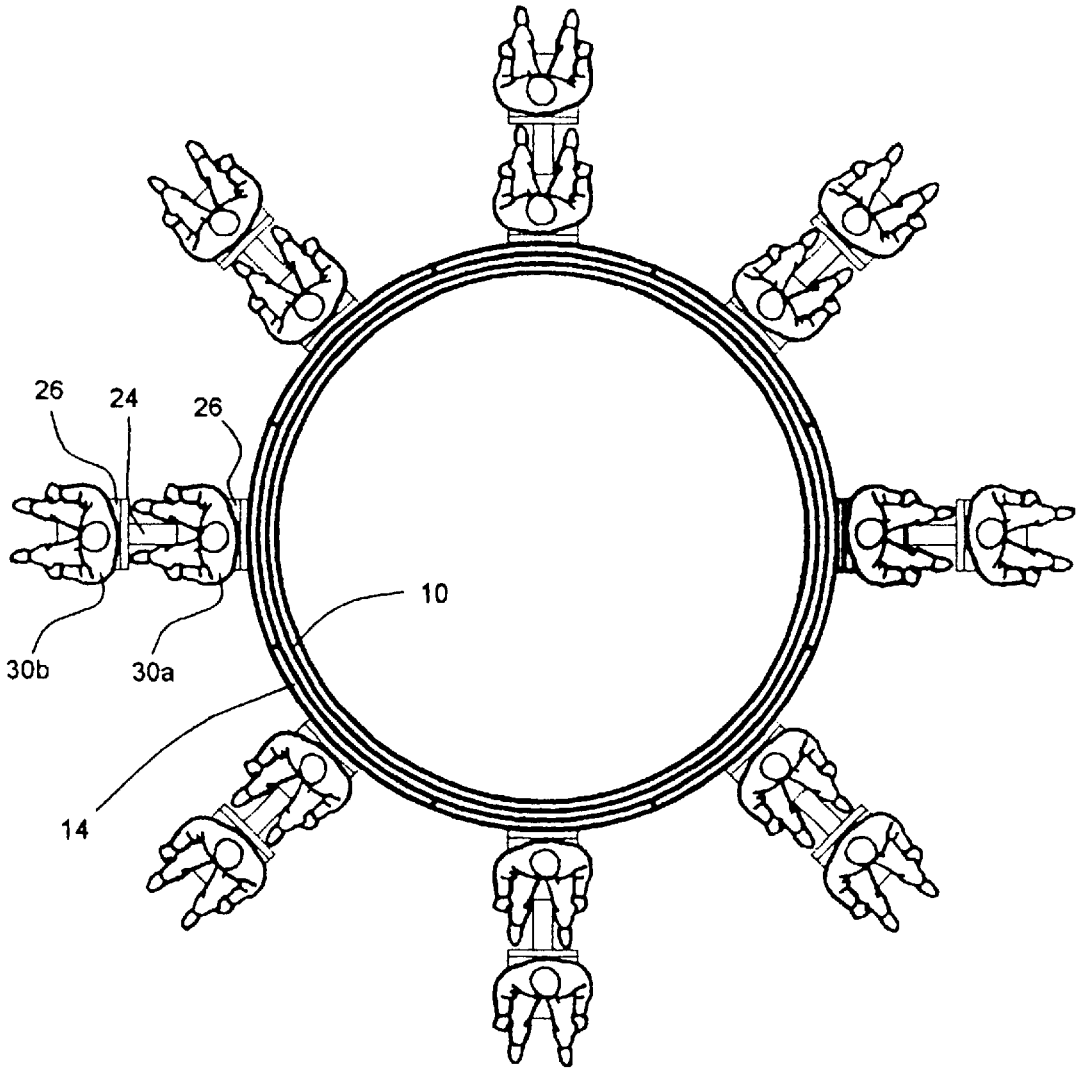
FIG. 3 is a schematic overhead view of an alternative embodiment of the present invention.

Referring now to FIG. 3, an alternative embodiment of the present invention is shown wherein the passenger seats 26 are configured radially from the carriage 14 such that a first passenger **30*a* is seated behind a second passenger 30*b*. Passenger 30*a* is seated in a more elevated position than passenger 30*b* so that both may view the surrounding area without significant obstruction, though this is not required. Both passenger seats 26 are supported by a radially extending support structure 24 coupled to the carriage 14. The passenger seats 26 are on top of the support structure 24 in this figure. Such a support structure can be a rigid bar or wall like structure. Though not shown, the passenger seats can also be coupled to the support structure such that the passenger seats are beneath the support structure. Additionally, the passenger seats 26** and/or the support structure can be configured to face and/or angle in any direction. For example the support structure could extend outwardly at a 45 degree angle with respect to the carriage and the passenger seats could be configured to face outwardly from tower. Thus, by angling the support structure and positioning the passenger seats to face away from the tower, outward views to all passengers can be unobstructed.

With these figures in mind, an amusement ride for providing vertical movement of a passenger is disclosed. Typically, the amusement ride comprises a support tower having a vertical movement mechanism wherein the movement mechanism defines a vertical movement path. The movement mechanism can be a cable system or some other lift system as is known in the art. Additionally, the vertical movement path can be provided by a combination of the cable system and the track, which may or may not be the tower itself. An example of an appropriate tower and lift or movement mechanism is described in U.S. Pat. No. 5,704,841, the entire teachings of which are incorporated herein by reference.

In the present invention, a carriage is typically coupled to the movement mechanism for providing travel along the vertical movement path, and a support structure is coupled to the carriage such that it extends outwardly or radially from the carriage to form a radially extended surface distal to the carriage. Though not necessarily required, it is preferred that at least two passenger seats be coupled to the support structure at a side surface essentially perpendicular to the radially extended surface distal to the carriage.

In this and other embodiments, passenger seats can be configured in relation to the support structure in many ways. In one embodiment, the passenger seats are positioned to face away from the tower as shown in FIG. 3. If two seats are used on the same support structure and face away from the tower, it is preferred that the seat closest to the tower be elevated to a higher position than the seat distal to the tower. If three or more seats are on a single support structure, each seat can be positioned such that it is higher than any seat immediately to its front. Alternatively, the support structure can also be angled such that the seat proximal to the tower can see outwardly as previously described. Either of these embodiments will enable both passengers to enjoy a view of the surrounding area.

In yet another embodiment, passenger seats can be positioned to face away from side surfaces as shown in FIGS. 1 and 2. In this configuration, if a plurality of support structures are similarly connected to the carriage such that they also extend radially from the carriage, passengers on adjacent support structures can view the expression on other passenger faces as they are propelled vertically. Additionally, in many of these embodiments, seats may be positioned above, beneath, on side surfaces of the support structures, or in any combination of these variable. Such configurations allow for the potential to fit more passengers onto a single tower ride than those described in the prior.

In another aspect of the present invention, an amusement ride for providing vertical movement of a passenger is disclosed which comprises a tower defining a vertical movement path and a passenger carrier for traveling along the vertical movement path. The passenger carrier preferably comprises a support structure extending radially or outwardly from the tower to form a radially extended surface distal to the tower, a first side surface, and an opposing second side surface. A first passenger seat can be coupled to the first side surface and a second passenger seat can be coupled to the opposing second side surface. Again, the passenger seats can be positioned in any direction, e.g. away from the tower, perpendicular to the tower, or any angle between. In a preferred embodiment having this configuration, a plurality of support structures are configured to extend radially from the tower such that each support structure has a first passenger seat coupled its respective first side surface and a second passenger seat coupled to its respective opposing second side surface. Thus, passengers on adjacent support structures can essentially face toward one another. At least two passenger seats can be coupled to each of the plurality of support structures at the first side surface, and at least two passenger seats can be coupled to each of the plurality of support structures at the opposing second side surface. Thus, more passengers may be loaded onto the amusement ride than is the case with many other vertical amusement rides that are present in the prior art.

In another embodiment, the support structure can be a wall having a first large surface, an opposing second large surface, and an edge coupled to the vertical movement mechanism. Thus, large portions of the passenger seats can be coupled to the first large surface and/or the opposing second large surface, giving the passenger seats a great amount of stability. Though in the figures, the wall structure is shown to be configured such that the wall structure is perpendicular to the tower, other angles can also be used. Again, each large surface can have one or multiple passenger seats, depending on the size and strength of the support structure.

In yet another alternative embodiment, an amusement ride for providing vertical movement is disclosed comprising a tower defining an essentially vertical movement path, a carriage moveably attached to the tower for travel along the vertical movement path, and a first seat and a second seat positioned radially in relation to the carriage such that the first seat is closer to the carriage than the second seat. If desired, the first seat can be positioned between the carriage and the second seat. Here, a radially extending support structure can be present to support the first seat and the second seat. The support structure can be a wall or some other structure functional for supporting the seats as previously described. Additionally, such a design provides flexibility as to the horizontal direction that the passenger seat may face. Again, the passenger seats can be positioned to face away from the tower, or alternatively, the passenger seats can be positioned to face other passenger seats. Further, as previously described, a first passenger seat may be elevate above or below a second passenger seat such that both passengers may have an unobstructed view.

A passenger carrier for vertical movement along a tower is also disclosed which comprises a carriage moveably coupled to the tower such that the carriage travels along a vertical movement path, a first support structure coupled to the carriage, a second support structure coupled to the carriage, a first chair attached to the first support structure, and a second chair attached to the second support structure such that the second chair is positioned to substantially face the first chair. Many of the variables previously described with respect to other embodiments can also apply to this embodiment.

While the invention has been described with reference to certain preferred embodiments, those skilled in the art will appreciate that various modifications, changes, omissions, and substitutions can be made without departing from the spirit of the invention. It is intended, therefore, that the invention be limited only by the scope of the following claims.

We claim:

1. An amusement ride for providing vertical movement of a passenger comprising:

a) a support tower having a vertical movement mechanism, said movement mechanism defining a vertical movement path;

b) a carriage coupled to the movement mechanism for providing travel along the vertical movement path;

c) a support structure connected to the carriage, wherein the support structure extends radially from the carriage to form a radially extended surface distal to the carriage; and d) at least two passenger seats coupled to the support structure at a side surface essentially perpendicular to the radially extended surface.

2. The amusement ride of claim 1 wherein the at least two passenger seats are positioned to face away from the tower.

3. The amusement ride of claim 2 wherein the bottom of the at least two passenger seats are coupled to the top of the support structure.

4. The amusement ride of claim 2 wherein one of the at least two passenger seats is elevated to a higher position than the other of the at least two passenger seats.

5. The amusement ride of claim 1 wherein the at least two passenger seats are positioned to face away from the side surface.

6. The amusement ride of claim 1 wherein at least two opposing seats are on a surface opposing the side surface.

7. The amusement ride of claim 6 having a plurality of support structures connected to the carriage, wherein the plurality of support structures extend radially from the carriage.

8. The amusement ride of claim 7 wherein at the least two passenger seats are coupled to each of the plurality of support structures at a side surface essentially perpendicular to the radially extending surface, and wherein the at least two opposing seats are on the surface opposing the side surface.

9. The amusement ride of claim 8 wherein the passenger seats are configured such that each seat essentially faces a seat on an adjacent support structure.

10. An amusement ride for providing vertical movement of a passenger comprising:

a) a tower defining a vertical movement path; and b) a passenger carrier for traveling along the vertical movement path, said passenger carrier comprising:

i) a support structure extending radially from the tower to form a radially extended surface distal to the tower, a first side surface, and an opposing second side surface;

ii) a first passenger seat coupled to the first side surface; and iii) a second passenger seat coupled to the opposing second side surface.

11. The amusement ride of claim 10 wherein the at least two passenger seats are positioned to face away from the tower.

12. The amusement ride of claim 10 wherein one of the at least two passenger seats is elevated to a higher position than the other of the at least two passenger seats.

13. The amusement ride of claim 10 wherein the at least two passenger seats are positioned to face away from the side surface.

14. The amusement ride of claim 10 having a plurality of support structures extending radially from the tower, each support structure having a first passenger seat coupled its respective first side surface and a second passenger seat coupled to its respective opposing second side surface.

15. The amusement ride of claim 14 wherein at least two passenger seats are coupled to each of the plurality of support structures at the first side surface, and at least two passenger seats are coupled to each of the plurality of support structures at the opposing second side surface.

16. The amusement ride of claim 14 wherein each first passenger seat is are configured to faces an opposing second passenger seat.

17. An amusement ride for providing vertical travel of a passenger comprising:

a) a tower defining a vertical movement path; and b) a passenger carrier for travel along the vertical movement path comprising:

i) a carriage movably coupled to the tower along the vertical movement path;

ii) a plurality of support structures coupled to and extending radially from said carriage; and iii) at least two seats coupled to each of said radially extending support structures.

18. The amusement ride of claim 17 wherein the at least two seats are coupled on top of the support structure.

19. The amusement ride of claim 17 wherein the at least two seats are coupled to a side surface of the support structure.

20. The amusement ride of claim 17 wherein the at least two seats are coupled to opposing side surfaces of the support structure.

21. An amusement ride for providing vertical movement of a passenger comprising:

a) a tower having a vertical movement mechanism, said movement mechanism defining a vertical movement path; and b) a passenger carrier for traveling along the vertical movement path, said passenger carrier comprising:

i) a wall having a first large surface, an opposing second large surface, and an edge coupled to the vertical movement mechanism; and ii) at least one passenger seat coupled to one of said first or second large surfaces.

22. The amusement ride of claim 21 wherein the first large surface and the opposing second large surface are essentially perpendicular to the tower.

23. The amusement ride of claim 21 wherein at least one passenger seat is coupled to the first large surface and at least one passenger seat is coupled to the opposing second large surface.

24. The amusement ride of claim 21 wherein at least two passenger seats are coupled to the first large surface.

25. The amusement ride of claim 24 wherein at least two passenger seats are coupled to the opposing second large surface.

26. An amusement ride for providing vertical movement comprising:

a) a tower defining an essentially vertical movement path;

b) a carriage moveably attached to the tower for travel along the vertical movement path; and c) a first seat and a second seat coupled to the carriage and positioned radially with respect to the carriage such that the first seat is closer to the carriage than the second seat.

27. The amusement ride of claim 26 wherein a radially extending support structure is present to further support the first seat and the second seat.

28. The amusement ride of claim 27 wherein at least one of the first seat and the second seat are each on a side surface of the support structure.

29. The amusement ride of claim 27 wherein at least one of the first seat and the second seat are on a top surface of the support structure.

30. The amusement ride of claim 27 wherein the support structure is a support wall.

31. The amusement ride of claim 26 wherein the first seat is positioned to face away from the tower.

32. The amusement ride of claim 31 wherein one of the at least two passenger seats is elevated to a higher position than the other of the at least two passenger seats.

33. The amusement ride of claim 26 wherein the second seat is positioned to face away from the tower.

34. The amusement ride of claim 26 wherein the first seat is positioned to face in a direction other than directly away from the tower.

35. The amusement ride of claim 26 wherein the second seat is positioned to face in a direction other than directly away from the tower.

36. A passenger carrier for vertical movement along a tower comprising:

a) a carriage moveably coupled to the tower such that the carriage travels along a vertical movement path;

b) a first support structure coupled to the carriage;

c) a second support structure coupled to the carriage;

d) a first chair attached to the first support structure; and e) a second chair attached to the second support structure such that the second chair is positioned to substantially face the first chair.

37. The passenger carrier of claim 36 wherein the first chair is positioned to substantially face the second chair.

* * * * *